US012690708B2

(12) United States Patent
Farris

(10) Patent No.: US 12,690,708 B2
(45) Date of Patent: Jul. 28, 2026

(54) CONTAINER STRAW, BEVERAGE KIT, METHOD FOR PREPARING THE BEVERAGE KIT, AND METHOD OF USING THE BEVERAGE KIT

(71) Applicant: Red River Tea Company, Dallas, TX (US)

(72) Inventor: Jeffrey B. Farris, Argyle, TX (US)

(73) Assignee: Red River Tea Company, Dallas, TX (US)

( * ) Notice: Subject to any disclaimer, the term of this patent is extended or adjusted under 35 U.S.C. 154(b) by 0 days.

(21) Appl. No.: 18/622,868

(22) Filed: Mar. 30, 2024

(65) Prior Publication Data

US 2025/0302218 A1 Oct. 2, 2025

(51) Int. Cl.
*A47G 21/18* (2006.01)
*B65D 41/28* (2006.01)

(52) U.S. Cl.
CPC ..... *A47G 21/18* (2013.01); *B65D 41/28* (2013.01)

(58) Field of Classification Search
CPC ..... A47G 21/18; A47G 21/183; B65D 41/28; B65D 75/12; A61J 7/0038; A23F 3/405
USPC ..... 220/705; 239/33; 426/85
See application file for complete search history.

(56) References Cited

U.S. PATENT DOCUMENTS 1,254,115 A * 1/1918 Brand ..... A47G 21/183 206/217
3,610,483 A * 10/1971 Visconti ..... A61J 7/0046 215/11.5
4,134,494 A * 1/1979 Wong ..... A47G 21/007 215/388
4,733,785 A * 3/1988 Turner, Jr. ..... B65D 77/283 215/229
4,792,333 A * 12/1988 Kidder ..... A61J 7/0038 604/83
4,981,468 A * 1/1991 Benefiel ..... A61J 7/0038 604/83
5,718,681 A * 2/1998 Manning ..... A47G 21/183 239/33
5,780,058 A * 7/1998 Wong ..... A61J 7/0038 424/464
6,638,549 B1 * 10/2003 Lloyd ..... B65D 75/12 426/115
7,011,255 B2 * 3/2006 Zuccaro ..... A47G 21/18 239/33
D602,726 S 10/2009 Baron
D719,388 S 12/2014 Ecseri
(Continued)

FOREIGN PATENT DOCUMENTS

CN 113842016 A 12/2021
FR 3022756 B1 9/2017
(Continued)

OTHER PUBLICATIONS

International Search Report and Written Opinion for PCT/US2025/021728 dated Sep. 12, 2025, 9 pages.

*Primary Examiner* — Steven A. Reynolds
(74) *Attorney, Agent, or Firm* — KLEMCHUK PLLC

(57) ABSTRACT

A container straw includes a tube whose first and second ends are sealed with first and second end caps, respectively, and a plurality of swellable food items sealed within the tube. The second end of the tube is angled to complementarily fit against an angled end face of the second end cap.

15 Claims, 10 Drawing Sheets

(56) References Cited

U.S. PATENT DOCUMENTS

| | | | | |
|---|---|---|---|---|
| 8,980,348 | B2 * | 3/2015 | Baron | A23F 3/405 426/89 |
| 9,572,444 | B2 | 2/2017 | Ecseri et al. | |
| D846,327 | S | 4/2019 | Peterson | |
| D888,483 | S | 6/2020 | Lin | |
| 10,987,278 | B2 * | 4/2021 | Nolimal | A61J 7/0038 |
| D938,773 | S | 12/2021 | Chen | |
| 2003/0071136 | A1 | 4/2003 | Ference | |
| 2003/0087005 | A1 | 5/2003 | Baron | |
| 2004/0076074 | A1 | 4/2004 | Shubeck | |
| 2007/0098851 | A1 * | 5/2007 | Williams | A47G 21/183 426/85 |
| 2008/0197141 | A1 * | 8/2008 | Felfoldi | A47G 21/183 220/705 |
| 2008/0300569 | A1 * | 12/2008 | Schateikis | A61K 45/06 604/403 |
| 2009/0041904 | A1 * | 2/2009 | Baron | A47G 21/183 426/394 |
| 2010/0159075 | A1 * | 6/2010 | Baron | A23L 2/56 426/77 |
| 2012/0055942 | A1 * | 3/2012 | Claessens | A47G 21/183 220/705 |
| 2012/0247993 | A1 * | 10/2012 | Palazzi | A61K 35/747 424/93.46 |
| 2013/0295232 | A1 * | 11/2013 | Baron | A23L 27/72 426/85 |
| 2014/0288495 | A1 | 9/2014 | Olmos | |
| 2018/0098652 | A1 * | 4/2018 | Ecseri | A47G 21/183 |
| 2020/0113363 | A1 * | 4/2020 | Nolimal | A47G 21/18 |
| 2023/0009089 | A1 * | 1/2023 | Cramsey | A47G 19/2272 |

FOREIGN PATENT DOCUMENTS

| | | | |
|---|---|---|---|
| JP | 2002102043 | A | 4/2002 |
| KR | 1020090093420 | A | 9/2009 |
| KR | 1020150069094 | A | 6/2015 |
| KR | 2020210000001 | U | 1/2021 |
| WO | 02096774 | A1 | 12/2002 |
| WO | 2008055296 | A1 | 5/2008 |
| WO | 2013030607 | A1 | 3/2013 |

* cited by examiner

CONTAINER STRAW, BEVERAGE KIT, METHOD FOR PREPARING THE BEVERAGE KIT, AND METHOD OF USING THE BEVERAGE KIT

FIELD OF THE DISCLOSURE

The present disclosure generally relates to straws for beverages that include food items that are swollen by the beverage.

BACKGROUND

Bubble tea, also known as boba tea, pearl milk tea, or tapioca tea, has gained immense popularity worldwide over the past few decades. Originally believed to have been developed in Taiwan in the 1980s, bubble tea is a unique beverage that combines tea, milk, sweeteners, and chewy tapioca pearls or other edible spheres, creating a delightful textural and sensory experience for consumers.

Traditional bubble tea recipes typically involve brewing tea leaves or using tea powders, adding sweeteners, blending with milk, and combining with cooked tapioca pearls before serving. Persons consuming bubble tea often suck up the swollen tapioca pearls from the bubble tea using a straw.

While bubble tea has become an iconic and beloved drink, there remain certain challenges and limitations with respect to its preparation and consumption. One significant drawback of conventional bubble tea beverages is the lack of a convenient solution for consuming bubble tea when the user is not in proximity to a bubble tea shop or is on the go and does not have the time to wait for the bubble tea to be prepared and consumed in a bubble tea shop.

Given the foregoing, there is a need for solution to the aforementioned problems.

SUMMARY

In some aspects, a container straw for containing swellable food items and consuming beverages made with the swellable food items in swollen form, includes: a transparent or translucent tube made of a food grade material that extends along an axis between first and second ends, the first end terminating at an end face that is disposed in a plane generally perpendicular to the axis, the second end being beveled and terminating at an end face that is disposed in a plane that is not perpendicular to the axis, wherein an angle, formed by the axis and the plane of the end face of the second end is within a range of 15-75°; a first end cap removably sealing the first end of the tube; and a second end cap removably sealing the second end of the tube, the second end cap including a solid or hollow cylindrical core portion and an annular collar portion, each of which extends along the axis, is made of an elastomeric material, and is contiguous with one another, wherein: the core portion is at least partially disposed within the tube at the second end thereof, the collar portion has an exteriorly-facing end and an interiorly-facing end, the interiorly-facing end is beveled and terminates in an end face that is disposed in a plane that is perpendicular to the axis, an angle, β, that is formed by the axis and the plane in which the end face of the interiorly-facing end is disposed is within a range of 105-165°, and α+β is equal to about 180° so that the end face of the interiorly-facing end and the end face of the second end of the tube face one another in complimentary fashion.

In some aspects, a beverage kit for use in consuming beverages containing swollen food items, comprises: the container straw and a plurality of dried swellable food items within an interior of the tube.

In some aspects, a method of preparing a beverage kit, includes: attaching a first end cap to a first end of a tube; filling the container straw with swellable food items; after filling, attaching a second end cap to a second end of the tube, prior to, during, or after addition of the swellable food items to the container, adding a beverage to the container; wherein the second end of the tube being beveled and terminating at an end face that is disposed in a plane that is not perpendicular to an axis of the tube, wherein an angle, formed by the axis and the plane of the end face of the second end is within a range of 15-75°; wherein the second end cap includes a solid or hollow cylindrical core portion and an annular collar portion, each of which extends along the axis, is made of an elastomeric material, and is contiguous with one another; wherein: the core portion is at least partially disposed within the tube at the second end thereof, the collar portion has an exteriorly-facing end and an interiorly-facing end, the interiorly-facing end is beveled and terminates in an end face that is disposed in a plane that is perpendicular to the axis, and an angle, β, that is formed by the axis and the plane in which the end face of the interiorly-facing end is disposed is within a range of 105-165°.

In some aspects, a method includes providing the beverage kit; removing at least one of the end caps from the tube; adding at least a portion of the swellable food items to a beverage container; prior to, during, or after addition of the swellable food items to the container, adding a beverage to the container; allowing the swellable food items to cook and/or soak in the beverage in the container; and after a desired duration of cooking or soaking time has elapsed, a user sucks up the beverage containing the swellable food items.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Disclosed is a container straw that is adapted and configured to store dried food items, and after the food items have been emptied from the container straw and become swollen in size after soaking and/or cooking in a beverage, the container straw is adapted and configured to allow the swollen food items to be sucked up out of a beverage container containing the beverage that includes the swollen food items. One end of the tube of the container straw is angled so as to more easily allow a use to pierce a plastic lid of a beverage container without damaging the tube through excessive bending thereof. The angled end of the tube and an angled feature of an end cap (that seals the angled end of the tube) are complementarily shaped so as to allow them to fit together to more securely seal that tube end with that end cap.

Container Straw

Figure 1:
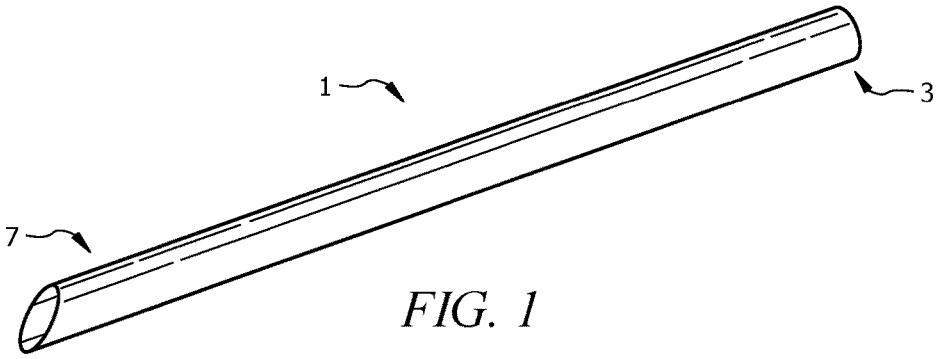
FIG. 1 is a perspective view of the tube.
Figure 2:
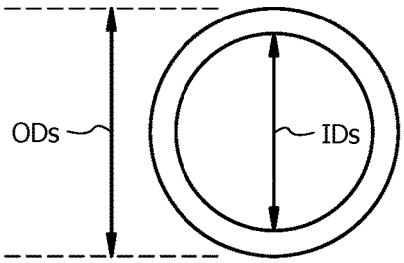
FIG. 2 is a cross-sectional view that is viewed along the axis of the tube.
Figure 3:
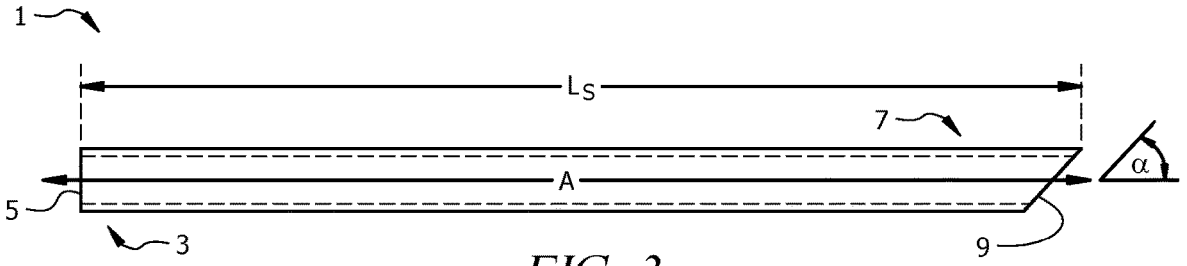
FIG. 3 is another cross-sectional view of the tube.

As shown in FIGS. 1-3, the container straw includes a transparent or translucent tube 1 that extends along an axis A and which has a first end 3 that terminates in an end face 5 that is disposed in a plane that is generally perpendicular to the axis A and a second end 7 that terminates in an end face 9 that is disposed in a plane that is not perpendicular to the axis A. Generally perpendicular includes that the plane of the end face 9 forms an angle with the axis A of no more than 10°. The second end 7 is beveled and an angle, α, formed by the axis A and the plane of the end face 9 of the second end 7 is within a range of 15-75°.

The tube 1 has a length $L_S$ extending from the end face 5 of the first end 3 to an outermost tip of the end face 9 of the second end 7. While $L_S$ may be of any value suitable for consuming beverages, in aspects, $L_S$ is within a range of from 200-400 mm. The tube 1 has an inner diameter $ID_S$ and an outer diameter $OD_S$. While $ID_S$ and $OD_S$ may have values suitable for consuming beverages containing food items that are swellable with the liquid of the beverage, in aspects, $ID_S$ is within the range of 8-20 mm and $OD_S$ has a value 0.25-1.0 mm greater than that of $ID_S$. The tube 1 is made of a food safe material and may be colored or non-colored as desired. In aspects, the tube 1 has a milky appearance and is translucent. In aspects, the tube 1 is made of food safe polypropylene. In aspects, $ID_S$ is within the range of 14-20 mm and $OD_S$ has a value 0.25-0.75 mm greater than that of $ID_S$.

Figure 4:
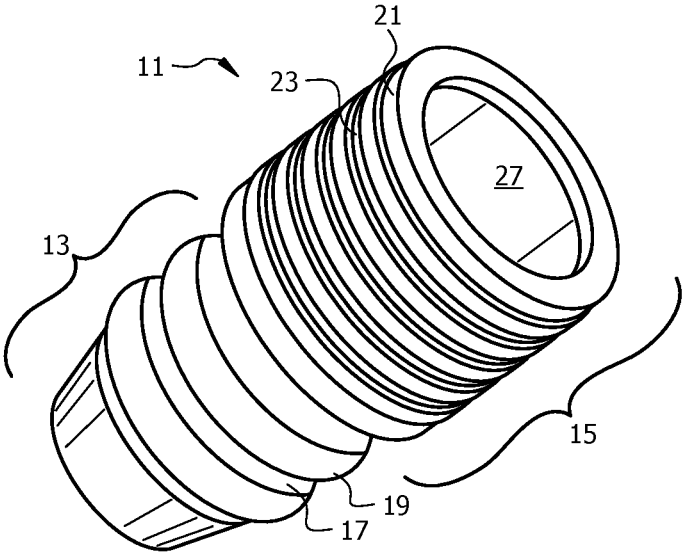
FIG. 4 is a perspective view of the first end cap.
Figure 5:
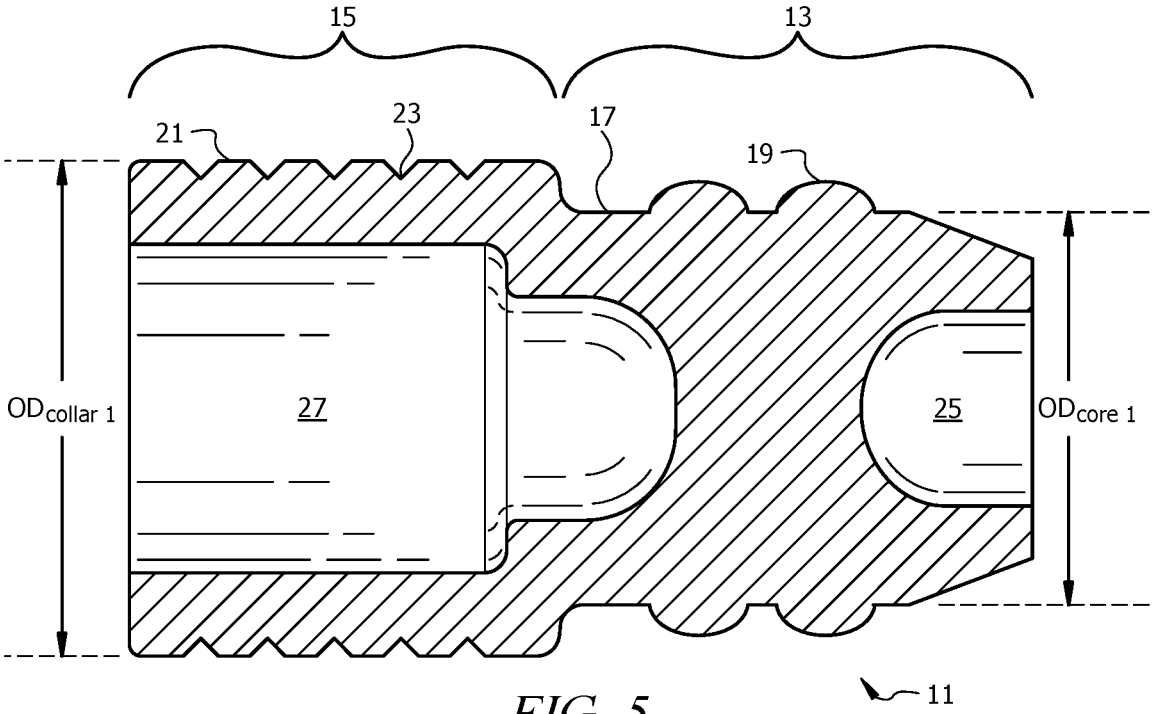
FIG. 5 is a cross-sectional view of the first end cap.

As illustrated in FIGS. 4-5, the first end cap 11 includes a core portion 13 and a collar portion 15. The core and collar portions 13, 15 are contiguous and each is made of a food safe elastomeric material. In aspects, the food safe elastomeric material is food safe silicone rubber having a durometer of about 50-80 durometer. Such a material is easily graspable by a user. In aspects, each of the core and collar portions 13, 15 are integral, made of a same material, and the first end cap 11 is manufactured through an injection molding process.

The core portion 11 has an outer diameter $OD_{core1}$ that is about equal to $ID_S$ and serves the function of removably sealing the first end 3 of the tube 1. By "about equal", it is meant that the $OD_{core1}$ is sized such that the core portion 13 may be inserted into an interior of the first end 3 of the straw 1 and frictionally retained therein through engagement with an inner surface of the straw 1 at the first end 3. One of ordinary skill in the art will recognize whether the $OD_{core1}$ is sized so as to allow the core portion 13 to be inserted into, and frictionally retained by, and subsequently withdrawn by a user therefrom, with a satisfactory amount of ease simply by manually inserting and withdrawing the core portion 13 into and from the first end 3. In aspects, $OD_{core1}$ is the same as $ID_S$. In aspects, an outer circumferential surface 17 of the core portion 13 is provided with one or more ribs projecting away from the outer circumferential surface 17 that serve the function of providing a snug fit of the core portion 13 within the first end 3 of the tube 1. By a snug fit, it is meant that, upon insertion of the core portion 13 within the first end 3 of the tube 1, the one or more ribs 19 are compressed against the inner surface of the first end 3 of the tube 1, thereby providing greater frictional retention of the core portion 13 within the first end 3 of the tube 1.

The collar portion 15 has a solid (not illustrated) or hollow cylindrical shape and serves the function of providing a surface for a user to grasp the first end cap 11 so as to withdraw it from the first end 3 of the tube 1, thereby unsealing the tube 1. The collar portion 15 has an outer diameter $OD_{collar1}$ that is slightly larger than, equivalent to, or slightly smaller than $OD_S$. By slightly larger and slightly smaller, it is meant that $OD_{collar1}$ has a value of 110% to 90% of that of $OD_S$, respectively. In aspects, $OD_{collar1}$ is slightly smaller than $OD_S$ and an outer circumferential surface 21 of the collar portion 15 includes one or more ribs (not illustrated) projecting outwardly therefrom and serves the purpose of offering a graspable surface to the user of the container straw. In aspects, $OD_{collar1}$ is slightly larger than $OD_S$ and the outer circumferential surface 21 of the collar portion 15 includes one or more grooves 23 formed therein and serves the purpose, again, of offering a graspable surface to the user.

In aspects, an inwardly-facing surface 25 of the core portion 13 is dished so as to create a hollow 25 therein. In aspects, the collar portion 15 has a hollow cylindrical shape and an outwardly-facing surface of the collar portion 15 is hollow and dished so as to create a hollow 27 therein. The optional hollows 25 and 27 allow a weight of the first end cap 11 to be reduced. Optional hollow 27 also serves the purpose of allowing a user to more easily grasp and pull the first end cap 11 from the first end 3 of the tube 1 and thereby unseal it.

Those of ordinary skill in the art will understand that the invention is not limited to each of the particular features of the first end cap 11 described above. Rather, any type of open tube sealing device known in the field of food packaging may be employed as the first end cap.

Figure 6:
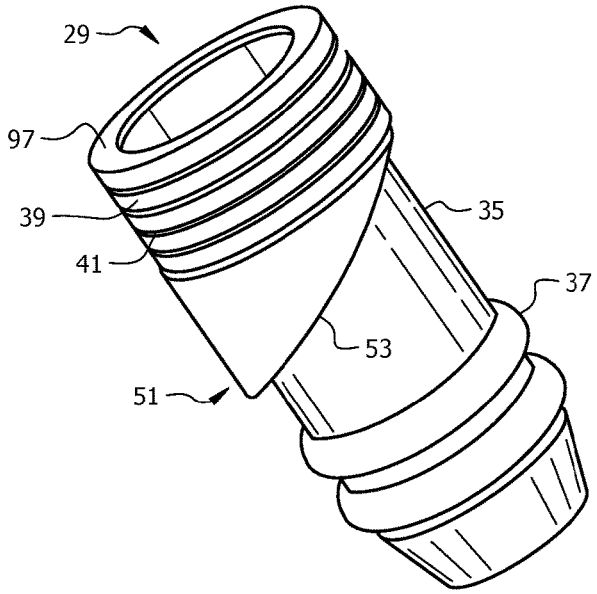
FIG. 6 is a perspective view of the second end cap.
Figure 7:
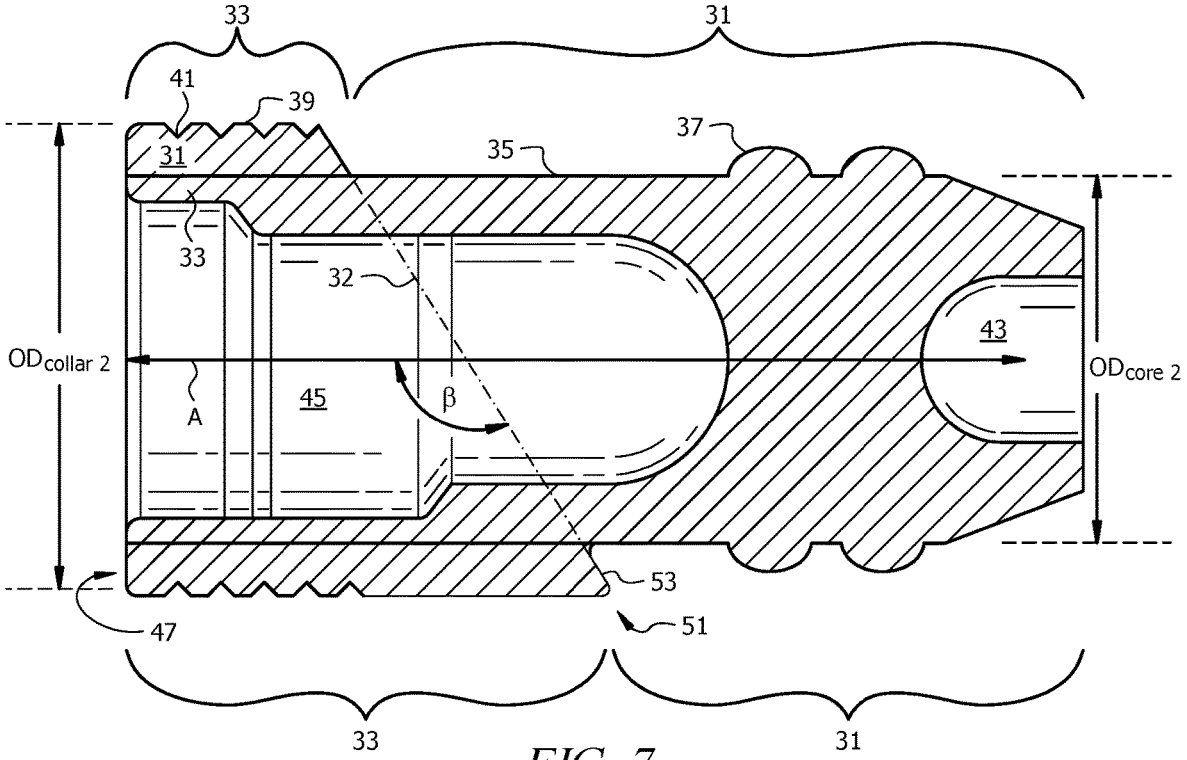
FIG. 7 is a cross-sectional view of the second end cap.

As shown in FIGS. 6-7, the second end cap 29 includes a core portion 31 and a collar portion 33. The core and collar portions 31, 33 are contiguous and each is made of a food safe elastomeric material. In aspects, the food safe elastomeric material is food safe silicone rubber having a durometer of about 50-80 durometer. Such a material is easily graspable by a user. In aspects, each of the core and collar portions 31, 33 are integral, made of the same material, and the second end cap 29 is manufactured through an injection molding process.

The core portion 31 has an outer diameter $OD_{core2}$ that is about equal to $ID_S$ and serves the function of removably sealing the second end 7 of the tube 1. By "about equal", it is meant that the $OD_{core2}$ is sized such that the core portion 31 may be inserted into an interior of the second end 7 of the straw 1 and frictionally retained therein through engagement with an inner surface of the straw 1 at the second end 7. One of ordinary skill in the art will recognize whether the $OD_{core2}$ is sized so as to allow the core portion 31 to be inserted into, and frictionally retained by, and subsequently withdrawn by a user therefrom, with a satisfactory amount of ease simply by manually inserting and withdrawing the core portion 31 into and from the second end 7. In aspects, $OD_{core2}$ is the same as $ID_S$. In aspects, an outer circumferential surface 35 of the core portion 13 is provided with one or more ribs (not illustrated) projecting away from the outer circumferential surface 35 that serve the function of providing a snug fit of the core portion 31 within the second end 7 of the tube 1. By a snug fit, it is meant that, upon insertion of the core portion 31 within the second end 7 of the tube 1, the one or more ribs 37 are compressed against the inner surface of the second end 7 of the tube 1, thereby providing greater frictional retention of the core portion 31 within the second end 7 of the tube 1.

The collar portion 33 has a solid (not illustrated) or hollow cylindrical shape and serves the function of providing a surface for a user to grasp the second end cap 29 so as to withdraw it from the second end 7 of the tube 1, thereby unsealing the tube 1. The collar portion 33 has an outer diameter $OD_{collar2}$ that is slightly larger than, equivalent to, or slightly smaller than $OD_S$. By slightly larger and slightly smaller, it is meant that $OD_{collar2}$ has a value of 110% to 90% of that of $OD_S$, respectively. In aspects, $OD_{collar2}$ is slightly smaller than $OD_S$ and an outer circumferential surface 39 of the collar portion 33 includes one or more ribs (not illustrated) projecting outwardly therefrom and serves the purpose of offering a graspable surface to the user of the container straw. In aspects, $OD_{collar1}$ is slightly larger than $OD_S$ and the outer circumferential surface 39 of the collar portion 33 includes one or more grooves 41 formed therein and serves the purpose, again, of offering a graspable surface to the user.

In aspects, an inwardly-facing surface of the core portion 31 is dished so as to create a hollow 43 therein. In aspects, the collar portion 33 has a hollow cylindrical shape and an outwardly-facing surface of the collar portion is hollow and dished so as to create a hollow 45 therein. The optional hollows 43, 45 allow a weight of the second end cap 29 to be reduced. Optional hollow 45 also serves the purpose of allowing a user to more easily grasp and pull the second end cap 29 from the second end 7 of the tube 1 and thereby unseal it.

The collar portion 33 has an exteriorly-facing end 47 and an interiorly-facing end 51. The interiorly-facing end 51 is beveled and terminates in an exposed end face 53 that is disposed in a plane that forms an angle, β, to the axis A that is within a range of 105-165°. Partially dashed line 32 denotes the portion of end face 35 that is not visible due to FIG. 7 being viewed in cross-section.

Figure 8:
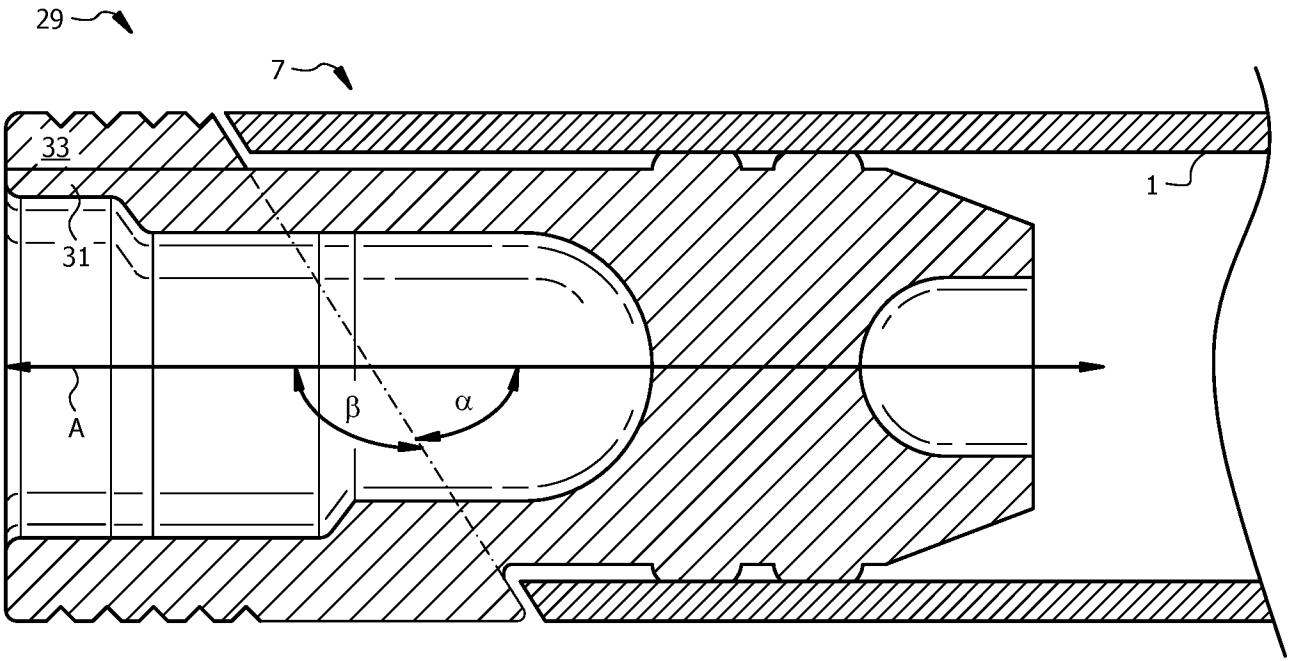
FIG. 8 is a cross-sectional view, with parts broken away, of the second end cap sealing the second end of the tube.
Figure 9:
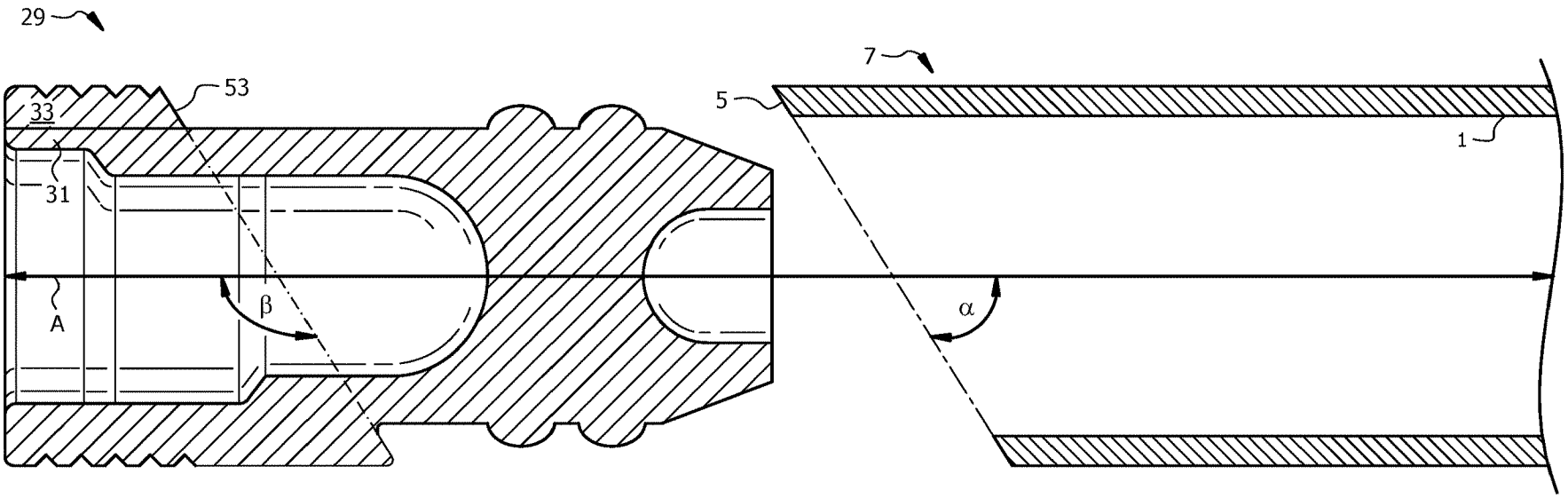
FIG. 9 is the exploded cross-sectional view of FIG. 8, with parts broken away.

As shown in FIGS. 8-9, the second end cap 29 seals the second end 7 through insertion into an interior of the tube 1 at the second end 7. The sum of the angles α and β is "about equivalent to 180°. By "about equal", it is meant that the sum is within a range of 170-190° such that the beveled inwardly-facing end 51 of the collar portion 33 faces the beveled second end 7 of the tube 1 in complimentary fashion. In other words, they fit together so as to allow the end face 53 to touch the end face 9. In aspects and as one non-limiting example, α is 58° and β is 122°.

Figure 10:
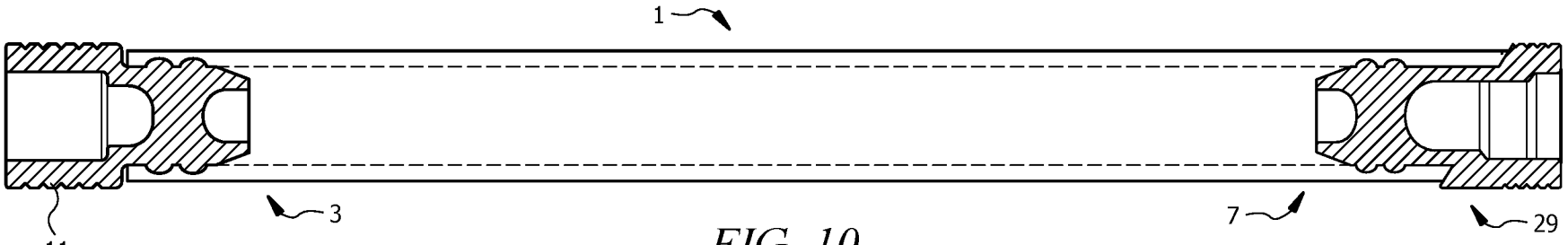
FIG. 10 is a cross-sectional view of the tube whose ends are sealed with end caps.

As shown in FIG. 10, the first end 3 of the tube 1 is sealed with the first end cap 11 while the second end 7 of the tube 1 is sealed with the second end cap 29.

Beverage Kit

The container straw may form part of a beverage kit useful in consuming beverages containing swellable food items. Thus, the beverage kit may include any one or more of the variations of the container straw described above as well as a plurality of dried swellable food items sealed within the tube by the end caps. The interior of the tube of the container straw may be completely or partially filled with the plurality of swellable food items. The beverage kit may be assembled by sealing either end of the tube with the corresponding end cap, filling the interior of the tube with a desired amount of the swellable food items and sealing the open end of the tube with the other corresponding end cap. Optionally, one or more of the container straws may be packaged in food packaging and labeled for use and sale.

Figure 11:
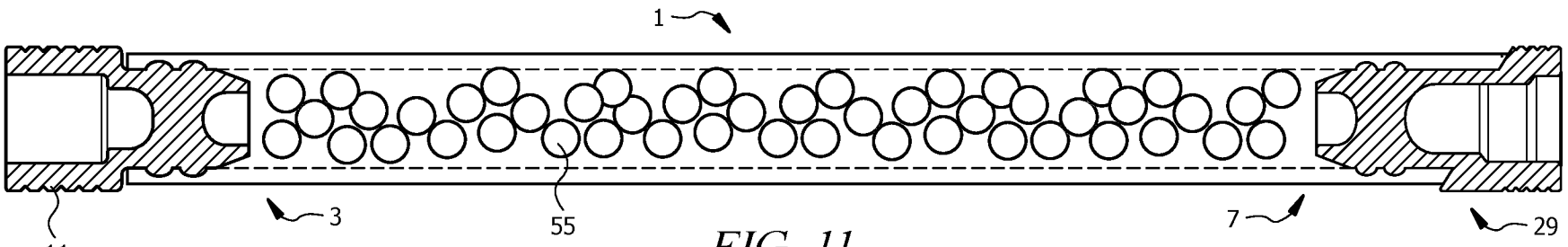
FIG. 11 is a cross-sectional view of the sealed tube of FIG. 10, including a plurality of swellable food items contained with an interior of the tube.

As shown in FIG. 11, the first end 3 of the tube 1 is sealed with the first end cap 11, the second end 7 of the tube 1 is sealed with the second end cap 29, and an interior of the tube 1 is at least partially filled with the swellable food items 55.

Alternative Embodiments of the Tube and End Caps

Figure 12:
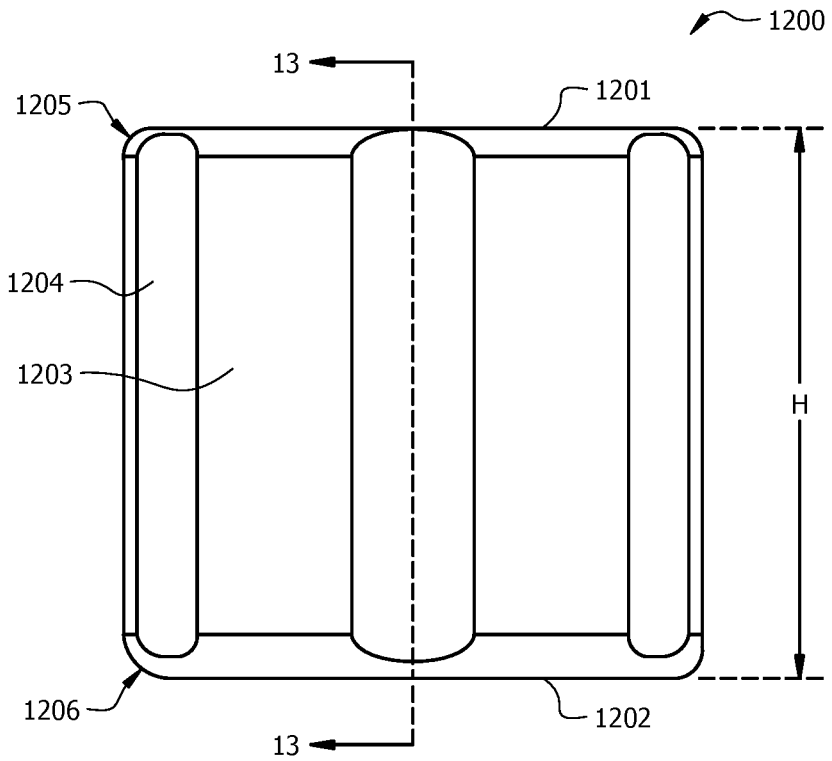
FIG. 12 is a side elevational view of an embodiment for the end caps.
Figure 13:
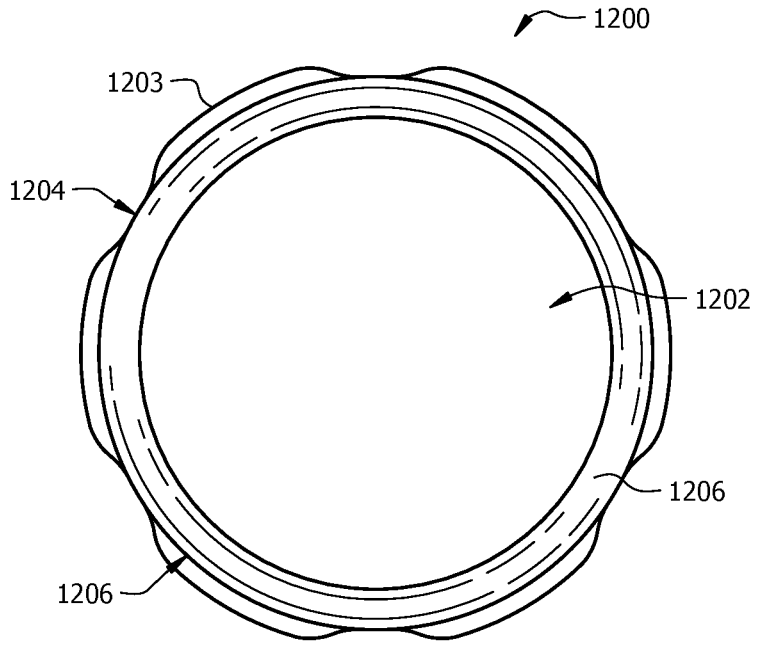
FIG. 13 is an end view of the embodiment in FIG. 12.
Figure 14:
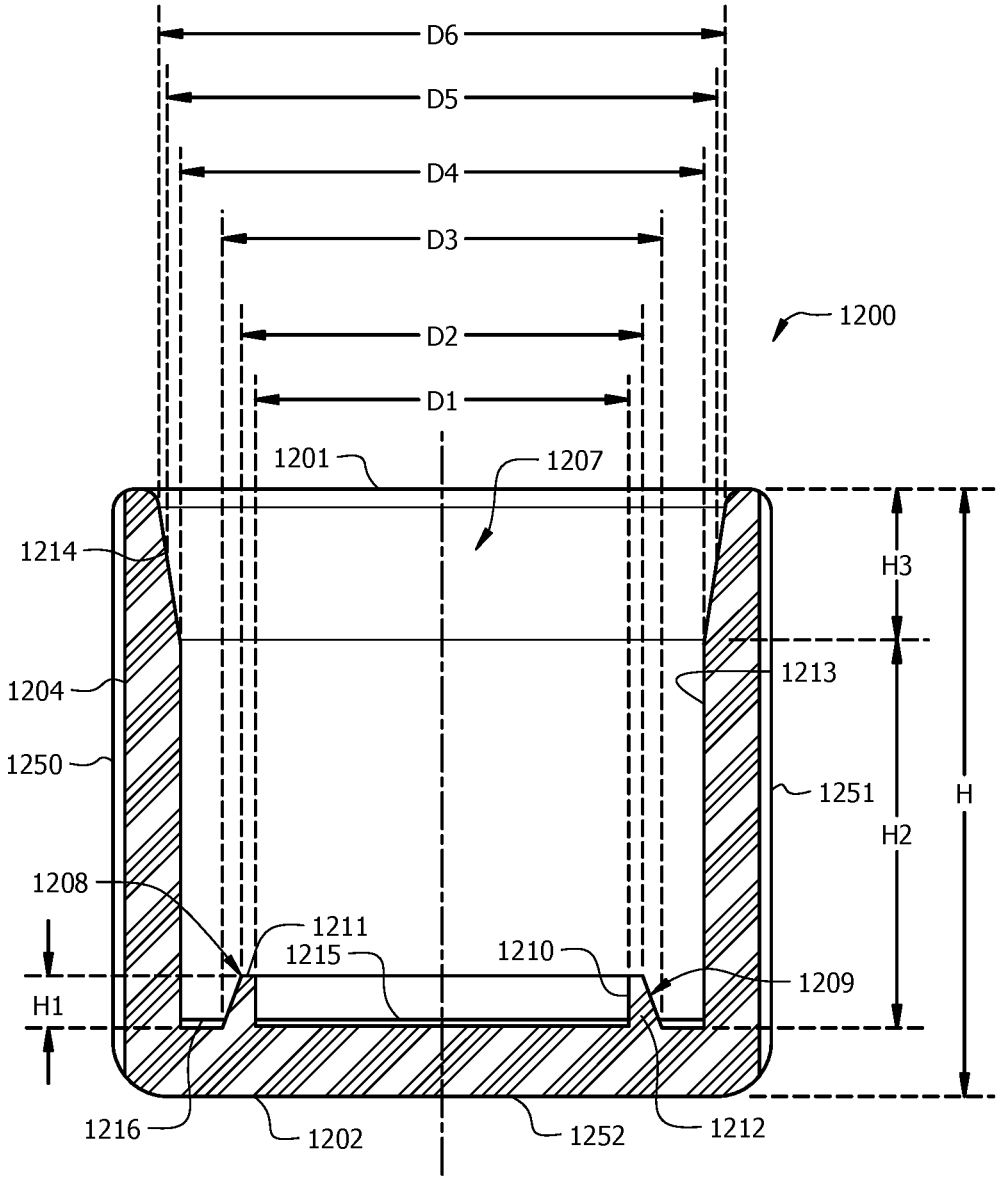
FIG. 14 is a cross-sectional view of the end cap embodiment in FIG. 12, taken along sight line A-A in FIG. 12.

FIGS. 12 to 14 show views of an embodiment for the end caps for another embodiment of tube 1. In these embodiments, the tube 1 has both ends cut perpendicularly with respect to the longitudinal axis of the tube 1 (i.e., there is no diagonal end). Thus, both ends of the tube 1 have end caps configured as illustrated in FIGS. 12 to 14.

FIG. 12 is a side elevational view of an embodiment for the end cap 1200. The shape of the end cap 1200 is generally cylindrical, with one end 1201 being open to receive an end of the tube 1 and an opposite end 1202 being closed and having structures on an inside thereof for sealing against the end of the tube 1.

The end cap 1200 has an end 1201 and an opposite end 1202, and a side surface 1203. The side surface 1203 has indentations 1204 formed therein to enhance gripping of the side surface 1203 of the end cap 1200. The end 1201 has a beveled edge 1205, and the end 1202 has a beveled edge 1206. The edge 1205 has a radius of curvature of about 0.03 inch. The edge 1206 has a radius of curvature of about 0.06 inch. A height H of the end cap 1200 can be in a range of from about 0.5 inch to about 1 inch; alternatively, about 0.6 inch. An outer diameter of the end cap 1200 can be in a range of from about 0.6 inch to about 0.7 inch; alternatively, about 0.641 inch. The indentations 1204 can be equally spaced on a circumference of the side surface 1203. A radius of curvature of the indentations 1204 can be about 0.23 inch in some aspects. A width of each of the indentations 1204 can be, for example, about 0.135 inch.

FIG. 13 is an end view of the embodiment of the end cap 1200 in FIG. 12. The end 1202, side surface 1203, indentations 1204, and beveled edge 1206 can be seen. The end 1202 is a solid surface that encloses the interior of the tube 1 when placed on the end of the tube 1.

FIG. 14 is a cross-sectional view of the end cap 1200 embodiment in FIG. 12, taken along sight line A-A in FIG. 12. The height H of the end cap 1200 is already described above. The end cap 1200 comprises a housing 1250 having a wall portion 1251 and a cap portion 1252 connected to the wall portion 1251 on end 1202 of the end cap 1200.

The housing 1250 has an opening 1207 that opens to a hollow interior on the end 1201 of the end cap 1200. The tube 1 is inserted into the hollow interior through the opening 1207. The portion 1214 of the inner wall of the housing 1250 is tapered near the end 1201, and is tapered to decrease in inner diameter from end 1201 in the direction of the cap portion 1252 of the end cap 1200. A height H3 of the portion that tapers in inner diameter is in a range of from about 0.1 to about 0.2 inch; alternatively, about 0.15 inch.

The portion of the inner wall 1213 that has a constant inner diameter has a height H2 in a range of from about 0.35 to about 0.45 inch; alternatively, about 0.384 inch. The cap portion 1252 on the end 1202 can be seen.

An inner surface 1215 of the end 1202 (also an inner surface 1215 of the cap portion 1252) has a bottom 1212 of a lip 1208 connected thereto. The lip 1208 extends toward the end 1201 and can have a height H1 in a range of from about 0.02 to about 0.08 inch; alternatively, from about 0.04 to about 0.06 inch; alternatively, about 0.05 inch. The lip 1208 can have an outer wall 1209 that faces the inner wall 1213 of the end cap 1200, an inner wall 1210, and a top 1211 that faces the end 1201 of the end cap 1200. The outer wall 1209 of the lip 1208 can be tapered such that a width of the lip 1208 that connects to the inner surface 1215 of the end 1202 is greater than the width of the top 1211 of the lip 1208.

The inner diameter D1 of the lip 1208 (the diameter of the inner wall 1210 and inner diameter of the top 1211 of the lip 1208) can range from about 0.3 to about 0.4 inch; alternatively, can be about 0.36 inch. The diameter D2 of the lip 1208 (the outer diameter of the top 1211 of the lip 1208) can range from about 0.37 to about 0.40 inch; alternatively, can be about 00.384 inch. The diameter D3 of the lip 1208 (the outer diameter of the lip 1208 and outer diameter of the outer wall 1209) can range from about 0.4 to about 0.44 inch; alternatively, can be about 0.42 inch. The diameter D4 of the end cap 1200 is the inner diameter of the inner wall 1213, and can range from about 0.5 to about 0.52 inch; alternatively, can be about 0.508 inch. The diameter D5 of the end cap 1200 is the smaller diameter of the taper of portion 1214 of the inner wall of the end cap 1200, and can range from about 0.51 to about 0.52 inch; alternatively, can be about 0.512 inch. The diameter D6 of the end cap 1200 is the larger diameter of the taper of portion 1214 of the inner wall of the end cap 1200, and can range from about 0.53 to about 0.54 inch; alternatively, can be about 0.535 inch.

When the end cap 1200 is placed on an end of the tube 1, an outer wall of the end of the tube 1 seals against the inner wall 1213 of the end cap 1200. Moreover, an end surface of the end of the tube 1 contacts a portion 1216 of the inner surface 1215 of the end 1202 of the end cap 1200. Further, the outer wall 1209 of the lip 1208 seals against the inner wall of the end of the tube 1. Thus, a triple seal is created by the end cap 1200: a first seal between the outer wall of the end of the tube 1 and the inner wall 1213 of the end cap 1200, a second seal between the end surface of the end of the tube 1 and the portion 1216 of the inner surface 1215 of the end 1202 of the end cap 1200, and a third seal between the inner wall of the end of the tube 1 and the outer wall 1209 of the lip 1208.

Figure 15:
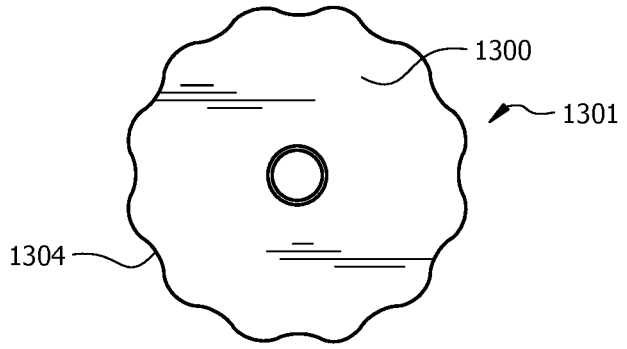
FIG. 15 is end view of an embodiment of one end caps, in place on an embodiment having end caps.
Figure 16:
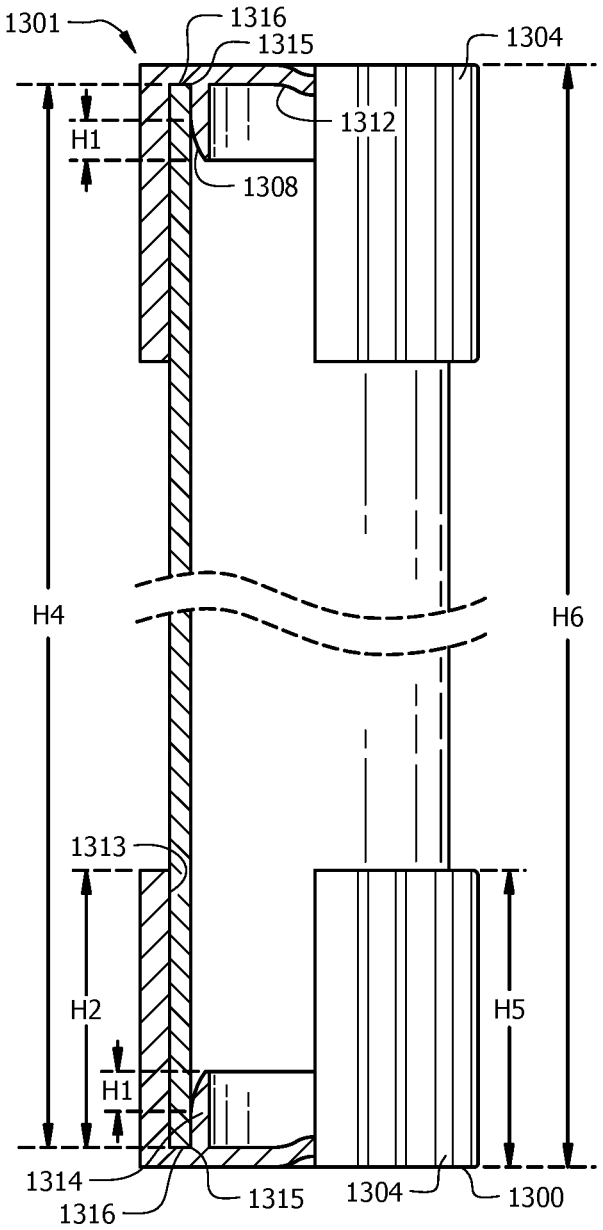
FIG. 16 is half-section view of embodiment employing end caps taken along sight line A-A in FIG. 15.
Figure 17:
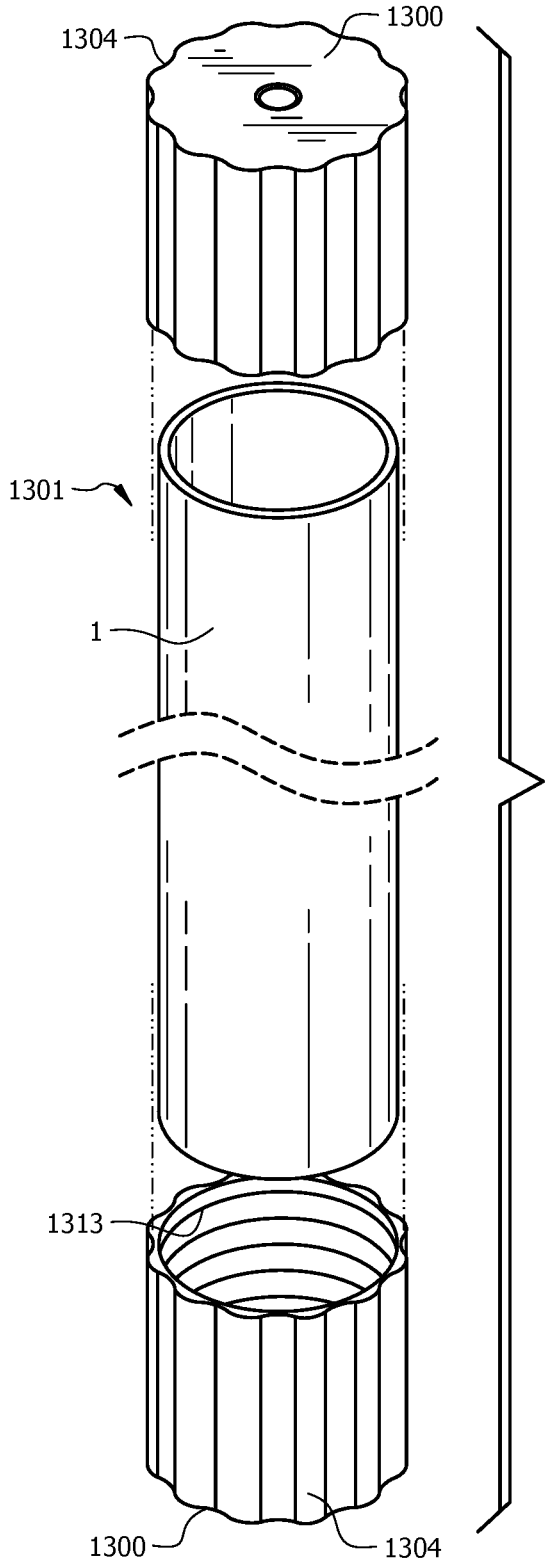
FIG. 17 is an exploded perspective side view of the embodiment depicted in FIGS. 15 and 16.

FIGS. 15, 16 and 17 depict another embodiment of the end cap 1200 depicted in FIGS. 12, 13 and 14. In particular, FIG. 15 depicts an end view of end cap 1300, which is a variation of the embodiment of the end cap 1200 in FIG. 12. Similar to end cap 1200, end cap 1300 can have indentations 1304 to enhance gripping of the side surface 1303 of the end cap 130. End cap 1300 can have a greater number of indentations 1304 than is the case for the indentations 1204 of end cap 1200.

As depicted FIG. 15, the indentations 1304 can be sufficiently numerous and closely spaced as to form a substantially continuously undulating surface around the periphery of end cap 1300, which improves the user's gripping ability.

As can be seen in FIG. 16, which is a half-section view of an assembled container straw 1301 with attached end caps 1300, and FIG. 17, which is an exploded view of the assembled container straw 1301 depicted in FIG. 16, the lower end of the assembled container straw 1301 can also have an end cap 1300 which can be, though need not be, substantially identical to end cap 1300 at the upper end of the assembled container straw 1301.

As can be seen in the exploded view of FIG. 17, the inside circumferential surface of the end cap 1300 at the lower end of can have ribs 1306 to enhance sealing of the inside surface of end cap 1300 to the outside surface of tube 1. The end cap 1300 at the upper end an have similar ribs on its inside circumferential surface (not shown in FIG. 17).

Returning to FIG. 16, the height H5 of the end caps 1300 at both ends can be the same as can be the same as "H" previously described for end cap 1200. The length H6 of the inside wall of the end cap 1300 can be the same as the sum of H2 and H3 of end cap 1200 as depicted in FIG. 14. Both end caps 1300 can have the same inside diameter D4 as end cap 1200. End cap 1300 need not have the internal taper of its opening 1307, though such an internal taper could be employed, if desired.

End cap 1300 has a bottom 1312 with an upstanding tapered circumferential lip 1308, similar to lip 1208 that extend toward the end 1201 of end cap 1200. Bottom 1312 can form an internal recess in the central portion of the cap, which allows material savings.

Similar to lip 1208, tapered lip 1308 can have a height H1 in a range of from about 0.02 to about 0.08 inch; alternatively, from about 0.04 to about 0.06 inch; alternatively, about 0.05 inch. The lip 1308 can have an outer wall 1309 that faces toward the inner wall 1313 of the end cap 1300, an inner wall 1310, and an angled free end 1311 that faces the inner surface of tube 1, when assembled.

The outer wall 1309 of the free end 1311 of lip 1308 can be tapered away from the tube 1 so that its distal end is thinner than its base. The base of lip 1308 as an un-tapered cylindrical portion 1312 with an outwardly facing un-tapered circumferential inner wall 1314.

Once the caps 1300 are assembled onto each end of the tube 1, only the outwardly facing circumferential inner wall 1314 will be in contact with the inside surface of the tube 1, not the tapered end of lip 1308. This construction avoids the tendency of a tapered surface to tend to push the cap 1300 endwise away from the end of tube 1 after the cap 1300 is pressed onto the end of tube 1.

The height of the tapered portion of lip 1308 can be the same height H3 as the tapered portion of lip 1208 and the tapered portion of lip 1308 can have an inner diameter in a range of from about 0.1 to about 0.2 inch; alternatively, about 0.15 inch. The corresponding respective diameters D1 to D4 can also be the same as those depicted in FIG. 14 and described with respect to that embodiment.

The portion of the inner wall 1313 of cap 1300 can have a height H2 in a range of from about 0.35 to about 0.45 inch; alternatively, about 0.384 inch.

When the end cap 1300 is placed on an end of the tube 1, an outer surface of the end of the tube 1 seals against the inner wall 1313 of the end cap 1300. Moreover, an end surface of the end of the tube 1 contacts a portion 1316 of the inner surface 1315 of the end 1302 of the end cap 1300. Further, the un-tapered portion of outer wall 1309 of the lip 1308 seals against the inner surface of the tube 1. Thus, a triple seal is created by the end cap 1300: a first seal between the outer wall of the end of the tube 1 and the inner wall 1313 of the end cap 1300, a second seal between the end surface of the end of the tube 1 and the portion 1316 of the inner surface 1315 of the end 1302 of the end cap 1300, and a third seal between the inner wall of the end of the tube 1 and the outer wall 1309 of the lip 1308.

By "swellable" it is meant that, upon cooking or soaking of the dried swellable food items in a beverage, the dried swellable food items become swelled with the liquid of the beverage. One of ordinary skill in the art will recognize that dried swellable food items may be distinguished from dried food items, such as powders, that are designed to be dissolved in the beverage instead of swelling in the beverage. While the degree to which the dry swellable food items are swollen in the beverage will depend upon the particular type of food item and beverage selected, in aspects, the dry swellable food items become swollen to 1.5-2.5 times their size prior to swelling, optionally 2.0-2.5 times their size prior to swelling. Taking into consideration that the swellable food items will increase in size after cooking or soaking, in aspects, the inner diameter of the tube of the container straw is sized to be at least 2.0 times the average diameter of the swellable food items stored within the container straw. For non-spherical swellable food items, the "average diameter" is measured prior to swelling, and is the largest length dimension of each item. In aspects, the average diameter of the swellable food items is 5-10 mm and the inner diameter of the tube is correspondingly 10-25 mm.

The particular type of swellable food item is not limited. In aspects, the swellable food item is tapioca pearls, also known as tapioca balls or boba pearls. Tapioca pearls are manufactured from tapioca, a starch that is derived from cassava root. They typically have a roughly spherical or ovoid configuration and have an outer diameter of from 5-10 mm. When selected, the tapioca pearls may be uncooked or partially cooked prior to being contained with the container straw.

In aspects, the tube of the container straw may optionally include dried flavorings such as cooked or uncooked edible food products, dried sweeteners, dried dairy products, dried diary-based products, and/or dried non-dairy milk products. In aspects, the sweetener is table sugar, brown sugar, palm sugar, date sugar, piloncillo, honey, corn syrup, malt syrup, molasses, dulce le leche, cajeta, aspartame, acesulfame-K, saccharin, sucralose, neotame, or advantame. In aspects, the dried dairy milk, is nonfat cow's milk, 1% cow's milk, 2% cow's milk, whole milk cow's milk, half & half, light cream, and/or heavy cream—each in dried form. In aspects, the dairy-based products include consumer products in dried form labeled as creamer, whether flavored or not. In aspects, the non-dairy milk is soy milk, oat milk, almond milk, and/or cashew milk—each in dried form.

Method of Preparing a Beverage Kit

A beverage kit may be prepared as follows. A first end cap is attached to a first end of a tube. The tube is filled with swellable food items. After filling, a second end cap is attached to a second end of the tube. Prior to, during, or after addition of the swellable food items to the container, a beverage is added to the container. The second end of the tube is beveled and terminates at an end face that is disposed in a plane that is not perpendicular to an axis of the tube. An angle, $\alpha$, formed by the axis and the plane of the end face of the second end is within a range of 15-75°. The second end cap comprises a solid or hollow cylindrical core portion and an annular collar portion, each of which extends along the axis, is made of an elastomeric material, and is contiguous with one another. The core portion is at least partially disposed within the tube at the second end thereof. The collar portion has an exteriorly-facing end and an interiorly-facing end. The interiorly-facing end is beveled and terminates in an end face that is disposed in a plane that is perpendicular to the axis. An angle, $\beta$, that is formed by the axis and the plane in which the end face of the interiorly-facing end is disposed is within a range of 105-165°. In aspects, $\alpha+\beta$ is about equal to 180° so that the end face of the interiorly-facing end and the end face of the second end of the tube face one another in complimentary fashion.

Method of Use

The beverage kit may be used as follows. At least one of the end caps of the container straw is removed by the user and at least a portion of the swellable food items are added in a container. Prior to, during, or after addition of the swellable food items to the container, a beverage is added to the container. The swellable food items are allowed to cook and/or soak in the beverage in the container. Once a desired duration of cooking or soaking time has elapsed, the tube of the container straw—now with both end caps removed—is used by the user to suck up the beverage containing the swellable food items.

The particular type of beverage is also not limited. In aspects, the beverage is tea, such as hot tea, room temperature tea, or iced tea, and may optionally include sweetener, dairy milk, dairy milk-based products, and/or non-dairy milk. In aspects, the tea, whether hot, room temperature, or iced, is black tea, white tea, or green tea, with or without coloring agents. In aspects, the tea is room temperature tea or iced tea which is initially in the form of hot tea and later cooled (such as with an addition of ice) after the cooking and/or soaking of the swellable food items). In aspects, the sweetener is table sugar, brown sugar, palm sugar, date sugar, piloncillo, honey, corn syrup, malt syrup, molasses, dulce le leche, cajeta, aspartame, acesulfame-K, saccharin, sucralose, neotame, or advantame. In aspects, the dairy milk, is nonfat cow's milk, 1% cow's milk, 2% cow's milk, whole milk cow's milk, half & half, light cream, and/or heavy cream. In aspects, the dairy-based products include consumer products labeled as creamer, whether flavored or not and in dry or liquid form. In aspects, the non-dairy milk is soy milk, oat milk, almond milk, and/or cashew milk.

In aspects, the swellable food item is tapioca pearls and the beverage is tea, optionally with a sweetener, dairy, dairy-based product, and/or non-dairy milk. This particular combination is often referred to as bubble tea (also known as pearl milk tea, bubble milk tea, tapioca milk tea, boba tea, or boba.

In aspects, the beverage is hot tea (to which ice is optionally added after the elapsed cooking and/or soaking time), the swellable food items are partially cooked tapioca pearls, and the beverage and the container straw are purchased from a convenience store. The beverage may optionally include one or more sweeteners, flavoring agents, or dairy milk, dairy-based, or non-dairy milk products described above. In use, at least one of the end caps of the container straw is removed by the user and at least a portion of the swellable food items are added in a beverage container (supplied by the convenience store). The tapioca pearls are allowed to cook and/or soak in the hot tea. Once a desired duration of cooking or soaking time has elapsed, ice may be optionally added to the hot tea, and regardless of whether ice is or is not added, the user pierces the exposed second end of the tube (after having had the second end cap removed by the user) through a perforation in a plastic lid covering the beverage container. The user then sucks up the beverage containing the swellable food items using the tube.

ADDITIONAL DISCLOSURE

Accordingly, the scope of protection is not limited by the description set out above but is only limited by the claims which follow, that scope including all equivalents of the subject matter of the claims. Each and every claim is incorporated into the specification as part of the disclosure. Thus, the claims are a further description and are an addition to the detailed description. The disclosures of all patents, patent applications, and publications cited herein are hereby incorporated by reference.

Aspect 1. A container straw for containing swellable food items and consuming beverages made with the swellable food in swollen form, comprising: a transparent or translucent tube made of a food grade material that extends along an axis between first and second ends, the first end terminating at an end face that is disposed in a plane generally perpendicular to the axis, the second end being beveled and terminating at an end face that is disposed in a plane that is not perpendicular to the axis, wherein an angle, $\alpha$, formed by the axis and the plane of the end face of the second end is within a range of 15-75°; a first end cap removably sealing the first end of the tube; and a second end cap removably sealing the second end of the tube, the second end cap comprising a solid or hollow cylindrical core portion and an annular collar portion, each of which extends along the axis, is made of an elastomeric material, and is contiguous with one another, wherein: the core portion is at least partially disposed within the tube at the second end thereof; the collar portion has an exteriorly-facing end and an interiorly-facing end; the interiorly-facing end is beveled and terminates in an end face that is disposed in a plane that is perpendicular to the axis; an angle, $\beta$, that is formed by the axis and the plane of the end face of the interiorly-facing end is within a range of 105-165°; and $\alpha+\beta$ is about equal to 180° so that the end face of the interiorly-facing end and the end face of the second end of the tube face one another in complimentary fashion.

Aspect 2. The container straw of aspect 1, wherein the tube has a length $L_S$ extending from the end face of the first end to an outermost tip of the end face of the second end within a range of 200-400 mm.

Aspect 3. The container straw of either of aspects 1 and 2, wherein an inner diameter of the tube is within a range of 8-20 mm.

Aspect 4. The container straw of any of aspects 1-3, wherein an outer diameter of the tube has a value that is 0.25-1.0 mm greater than that of the inner diameter of the tube.

Aspect 5. The container straw of any of aspects 1-4, wherein the tube is made of a food safe material that is clear or colored.

Aspect 6. The container straw of any of aspects 1-5, wherein the tube is translucent and made of food safe polypropylene.

Aspect 7. The container straw of any of aspects 1-6, wherein the core and collar portions of the first end cap are integral with one another, the core and collar portions of the second end cap are integral with one another, and the core and collar portions of the first and second end caps are made of a food safe elastomeric material.

Aspect 8. The container straw of any of aspects 1-7, wherein the food safe elastomeric material is food safe silicone rubber having a durometer of about 50-80 durometer.

Aspect 9. The container straw of any of aspects 1-8, wherein each of the first and second end caps is manufactured through an injection molding process.

Aspect 10. The container straw of any of aspects 1-9, wherein the core portion of the first end cap has an outer diameter that is about equal to an inner diameter of the straw.

Aspect 11. The container straw of any of aspects 1-10, wherein the collar portion of the first end cap has a solid or hollow cylindrical shape.

Aspect 12. The container straw of any of aspects 1-11, wherein an outer diameter of the collar portion of the first end cap is slightly larger than, equivalent to, or slightly smaller than an outer diameter of the tube.

Aspect 13. The container straw of any of aspects 1-12, wherein an outer circumferential surface of the collar portion of the first end cap includes one more ribs projecting outwardly therefrom.

Aspect 14. The container straw of any of aspects 1-13, wherein an outer circumferential surface of the collar portion of the first end cap includes one or more grooves formed therein.

Aspect 15. The container straw of any of aspects 1-14, wherein an outer diameter of the core portion of the second end cap is about equal to an inner diameter of the tube.

Aspect 16. The container straw of any of aspects 1-15, wherein an outer circumferential surface of the core portion of the second end cap is provided with one or more ribs projecting away from the outer circumferential surface.

Aspect 17. The container straw of any of aspects 1-16, wherein an outer circumferential surface of the collar portion of the second end cap includes one more ribs projecting outwardly therefrom.

Aspect 18. The container straw of any of aspects 1-17, wherein an outer circumferential surface of the collar portion of the second end cap includes one or more grooves formed therein.

Aspect 19. The container straw of any of aspects 1-18, wherein the end face of the inwardly-facing end of the collar portion faces the beveled second end of the tube in complimentary fashion so that the inwardly-facing end of the collar portion touches the end face of the second end of the tube.

Aspect 20. A beverage kit for use in consuming beverages containing swollen food items, comprising the container straw of any of aspects 1-19 and a plurality of dried swellable food items within an interior of the tube.

Aspect 21. The beverage kit of aspect 20, wherein the dry swellable food items are swellable, in beverages, to 1.5-2.5 times their size prior to swelling.

Aspect 22. The beverage kit of either of aspects 20 or 21, wherein the swellable food items have an average diameter of 5-10 mm.

Aspect 23. The beverage kit of any of aspects 20-22, wherein an inner diameter of the tube is sized to be at least 2.0 times the average diameter of the swellable food items stored within the tube.

Aspect 24. The beverage kit of any of aspects 20-23, wherein the swellable food item is tapioca pearls.

Aspect 25. The beverage kit of any of aspects 20-24, wherein the tapioca pearls have an outer diameter of 5-10 mm.

Aspect 26. The beverage kit of any of aspects 20-25, wherein the tapioca pearls are uncooked or partially cooked.

Aspect 27. The beverage kit of any of aspects 20-26, wherein dried flavorings, dried sweeteners, dried dairy products, dried diary-based products, and/or dried non-dairy products are further contained within the interior of the tube.

Aspect 28. A method of using a beverage kit, comprising: providing the beverage kit of any of aspects 20-27; removing at least one of the end caps from the tube; adding at least a portion of the swellable food items to a beverage container; prior to, during, or after addition of the swellable food items to the container, adding a beverage to the container; allowing the swellable food items to cook and/or soak in the beverage in the container; and after a desired duration of cooking or soaking time has elapsed, a user sucks up the beverage containing the swellable food items.29

Aspect 29. The method of aspect 28, wherein the beverage is tea.

Aspect 30. The method of either of aspects 28 or 29, wherein the tea is hot tea, room temperature tea, or iced tea.

Aspect 31. The method of any of aspects 28-30, wherein the beverage includes a sweetener, dairy milk, a dairy milk-based product, and/or a non-dairy milk.

Aspect 32. The method of any of aspects 28-32, wherein the beverage is tea that includes a sweetener, dairy milk, a dairy milk-based product, and/or a non-dairy milk.

Aspect 33. A method of preparing a beverage kit, comprising: attaching a first end cap to a first end of a tube; filling the tube with swellable food items; after filling, attaching a second end cap to a second end of the tube, prior to, during, or after addition of the swellable food items to the container, adding a beverage to the container; wherein the second end of the tube being beveled and terminating at an end face that is disposed in a plane that is not perpendicular to an axis of the tube, wherein an angle, α, formed by the axis and the plane of the end face of the second end is within a range of 15-75°; wherein the second end cap comprises a solid or hollow cylindrical core portion and an annular collar portion, each of which extends along the axis, is made of an elastomeric material, and is contiguous with one another; wherein: the core portion is at least partially disposed within the tube at the second end thereof, the collar portion has an exteriorly-facing end and an interiorly-facing end, the interiorly-facing end is beveled and terminates in an end face that is disposed in a plane that is perpendicular to the axis, and an angle, β, that is formed by the axis and the plane in which the end face of the interiorly-facing end is disposed is within a range of 105-165°.

Aspect 34. The method of aspect 33, wherein α+β is about equal to 180° so that the end face of the interiorly-facing end and the end face of the second end of the tube face one another in complimentary fashion.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A container straw for containing swellable food items and consuming beverages made with the swellable food items in swollen form, comprising:

a transparent or translucent tube made of a food grade material that extends along an axis between first and second ends, the first end terminating at a first end face that is disposed in a first plane generally perpendicular to the axis, the second end either i) being beveled and terminating at a second end face that is disposed in a second plane that is not perpendicular to the axis, wherein an angle, α, formed by the axis and the second plane of the second end face of the second end is within a range of 15-75° or ii) terminating at the second end face that is disposed in a third plane generally perpendicular to the axis;

a first end cap removably sealing the first end of the tube; and a second end cap removably sealing the second end of the tube;

wherein the second end is beveled and terminating at the second end face that is disposed in the second plane that is not perpendicular to the axis, wherein the angle, α, formed by the axis and the second plane of the second end face of the second end is within a range of 15-75°, wherein the second end cap comprises a solid or hollow cylindrical core portion and an annular collar portion, each of which extends along the axis, is made of an elastomeric material, and is contiguous with one another, wherein:

the core portion of the second end cap is at least partially disposed within the tube at the second end thereof, the collar portion of the second end cap has an exteriorly-facing end and an interiorly-facing end, the interiorly-facing end of the second end cap is beveled and terminates in an end face that is disposed in a plane that is perpendicular to the axis, an angle, β, that is formed by the axis and the plane in which the end face of the interiorly-facing end of the second end cap is disposed is within a range of 105-165°, and α+β is equal to about 180° so that the end face of the interiorly-facing end of the second end cap and the end face of the second end of the tube face one another in complimentary fashion.

2. The container straw of claim 1, wherein the first end cap has core and collar portions that are integral with one another, the core and collar portions of the second end cap are integral with one another, and each of the core and collar portions of the first and second end caps are made of a food safe elastomeric material.

3. The container straw of claim 2, wherein the first end cap has a core portion and the core portion of the first end cap has an outer diameter that is about equal to an inner diameter of the straw.

4. The container straw of claim 1, wherein the first end cap has a collar portion and the collar portion of the first end cap has a solid or hollow cylindrical shape.

5. The container straw of claim 1, wherein the first end cap has a collar portion and an outer diameter of the collar portion of the first end cap is slightly larger than, equivalent to, or slightly smaller than an outer diameter of the tube.

6. The container straw of claim 1, wherein the first end cap has a collar portion and an outer circumferential surface of the collar portion of the first end cap includes one more ribs projecting outwardly therefrom.

7. The container straw of claim 1, wherein the first end cap has a collar portion and an outer circumferential surface of the collar portion of the first end cap includes one or more grooves formed therein.

8. The container straw of claim 1, wherein an outer diameter of the core portion of the second end cap is about equal to an inner diameter of the tube.

9. The container straw of claim 1, an outer circumferential surface of the core portion of the second end cap is provided with one or more ribs projecting away from the outer circumferential surface.

10. The container straw of claim 1, wherein an outer circumferential surface of the collar portion of the second end cap includes one more ribs projecting outwardly therefrom.

11. The container straw of claim 1, wherein an outer circumferential surface of the collar portion of the second end cap includes one or more grooves formed therein.

12. The container straw of claim 1, wherein the interiorly-facing end of the collar portion faces the beveled second end of the tube in complimentary fashion so that the end face of an inwardly-facing end of the collar portion touches the end face of the second end of the tube.

13. The container straw of claim 1, wherein the second end terminates at the second end face that is disposed in the third plane generally perpendicular to the axis, wherein the second end cap comprises:

a housing having a wall portion and a cap portion connected to the wall portion on an end of the second end cap; and a lip connected to an inner surface of the cap portion, wherein a portion of an inner surface of the cap portion extends between an inner wall of the wall portion and an outer wall of the lip.

14. The container straw of claim 13, wherein when the end of the tube is inserted into the second end cap, three seals are created: a first seal between an outer wall of the end of the tube and the inner wall of the wall portion, a second seal between an end surface of the end of the tube and the portion of the inner surface of the cap portion, and a third seal between an inner wall of the end of the tube and the outer wall of the lip.

15. A method of using a container straw as defined in claim 1, comprising the steps of:

removing at least one of the end caps from the tube;

adding at least a portion of swellable food items to a beverage container;

prior to, during, or after addition of the swellable food items to the beverage container, adding a beverage to the beverage container;

allowing the swellable food items to cook and/or soak in the beverage in the container; and after a desired duration of cooking or soaking time has elapsed, a user sucks up the beverage containing the swellable food items.

* * * * *